US006289944B1

(12) United States Patent
Frommenwiler

(10) Patent No.: US 6,289,944 B1
(45) Date of Patent: Sep. 18, 2001

(54) METHOD AND EQUIPMENT FOR THE TREATMENT AND TWISTING TOGETHER OF A CONDUCTOR PAIR

(75) Inventor: Franz Frommenwiler, Rothenburg (CH)

(73) Assignee: Komax Holding AG, Dierikon (CH)

( * ) Notice: Subject to any disclaimer, the term of this patent is extended or adjusted under 35 U.S.C. 154(b) by 0 days.

(21) Appl. No.: 09/507,865

(22) Filed: Feb. 22, 2000

(30) Foreign Application Priority Data

Feb. 23, 1999 (EP) ..... 99810159

(51) Int. Cl.[7] ..... B21F 7/00
(52) U.S. Cl. ..... 140/149
(58) Field of Search ..... 140/149

(56) References Cited

U.S. PATENT DOCUMENTS 5,931,203 * 8/1999 Kredler et al. ..... 140/149

FOREIGN PATENT DOCUMENTS 196 49 759 6/1998 (DE) .
889 486 1/1999 (EP) .

* cited by examiner

*Primary Examiner*—Lowell A. Larson
(74) *Attorney, Agent, or Firm*—Cohen, Pontani, Lieberman & Pavane

(57) ABSTRACT

A twisting apparatus for treating three conductor pairs at the same time. The leading conductor ends are fed by a first pivotal unit to first automatic devices for treatment and equipping. An extraction carriage then takes over the leading conductor ends and draws the conductors out to the desired length. A take-over module takes over the leading conductor ends and brings these to a twisting head. The trailing conductor ends are taken over by a second pivotal unit and fed to second automatic devices for treatment and equipping. A transfer module takes over the finished treated trailing conductor ends and transfers these to a retaining module. The conductor pair situated between the retaining module and the twisting head is twisted with regulated tension force and then passes into a deposit. At the same time, the leading conductor ends of one conductor pair are treated and equipped, one stretched conductor pair is treated, equipped and transferred and one conductor pair is twisted together.

9 Claims, 9 Drawing Sheets

METHOD AND EQUIPMENT FOR THE TREATMENT AND TWISTING TOGETHER OF A CONDUCTOR PAIR

BACKGROUND OF THE INVENTION

1. Field of the Invention

The invention relates to a method and equipment for the treatment and twisting together of a conductor pair which is stretched, clamped in at both ends and twisted together from one end of the conductor pair.

2. Discussion of the Prior Art

A conductor pair that is twisted together consists of two conductors twisted together and is suitable for data transmission, for example in vehicles. Each conductor has a helical course, wherein the two conductors are coiled closely one against the other and form upper and lower conductor loops in alternating sequence. A conductor portion with a respective upper and lower loop is denoted as lay. Lay lengths and lay symmetry are parameters of a conductor pair which is twisted together, which parameters are of significance with respect to the electromagnetic compatibility (EMV) and must lie within preset tolerance values.

Conductor pairs that are twisted together are produced manually, semi-automatically or fully automatically, wherein the basic working steps remain the same. After cutting to length, the individual conductors are clamped at one end in a stationary clamping device and at the other end in a displaceable clamping device with a rotary head and then stretched over the entire length. Thereafter, the twisting together takes place from one end of the individual conductors by means of the clamping device with the rotary head.

A device for the mechanical manufacture of conductor pairs that are twisted together is known from German reference DE 196 49 759. The two individual conductors are each drawn off from a respective coil and cut to the desired length. A finishing machine equips the individual conductors at both ends with plugs or coupling members. Thereafter, each conductor is clamped by a respective one end in a fixed mounting and by the other end in a spindle-driven mounting which stretches the individual conductors freely over their entire length. The twisting together then takes place from the spindle-driven mounting.

The known equipment is of sufficient performance for small charges with respect to produced piece numbers per unit of time. For greater charges, the performance capability of such equipment is no longer adequate. Increases in performance are hardly possible because the equipping, stretching and twisting together of the individual conductors can hardly be shortened in time.

SUMMARY OF THE INVENTION

It is, accordingly, an object of the present invention to provide a method and equipment for making large charges of twisted conductor. The invention, solves the problem of avoiding the disadvantages of the known equipment and creating an efficient production plant for automatic manufacture of conductors twisted together. This is achieved by a combination of machines which conventionally operate one independently of the other and by the avoidance of unproductive transport or transfer steps, as is not possible at all with individual machines connected one behind the other.

Pursuant to the above object, one aspect of the present invention resides in an apparatus for treating and twisting together a conductor pair, which apparatus comprises a device for treating and equipping leading and trailing ends of the conductor, and a device for subsequently twisting together the conductor pair. The treating and equipping device includes units for treating and equipping the trailing conductor end, which units are arranged directly beside the twisting device. Another aspect of the present invention resides in a method for treating and twisting together a conductor pair, which method comprises the steps of stretching each conductor pair, treating a leading conductor end, treating a trailing conductor end, clamping both ends of each conductor pair, and twisting together each conductor pair from one end. At least two of the following steps being performed simultaneously: the treating of the leading conductor end; the treating of the trailing conductor end; and the twisting together of the conductor pair.

The advantages achieved by the invention are to be seen substantially in that up to three conductor pairs can be treated simultaneously in parallel operation, whereby a substantial increase in performance by comparison with conventional twisting machines is possible for the manufacture of conductor pairs that are twisted together. The conductors are stretched in their length only once in the entire production process and need neither be turned or retracted nor transported. Furthermore, it is advantageous that both conductor ends are retained by grippers during the manufacture ready for use and the twisting-together. Thereby, unnecessary loss times during the manipulation of the conductors are avoided. Moreover, the conductors cannot form any loops or twist at the ends. During the stretching of the conductors to the desired length, the tension forces in the conductors are watched. The tension forces in the conductors are regulated during the stretching of the conductors and/or the twisting together. Thereby, knots or loops are recognized. The regulation of the tension force during the twisting together, in particular during the shortening of the entire conductor length resulting due to the twisting process, improves the quality of the twisted conductor pair, for example with respect to lay length and lay symmetry.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
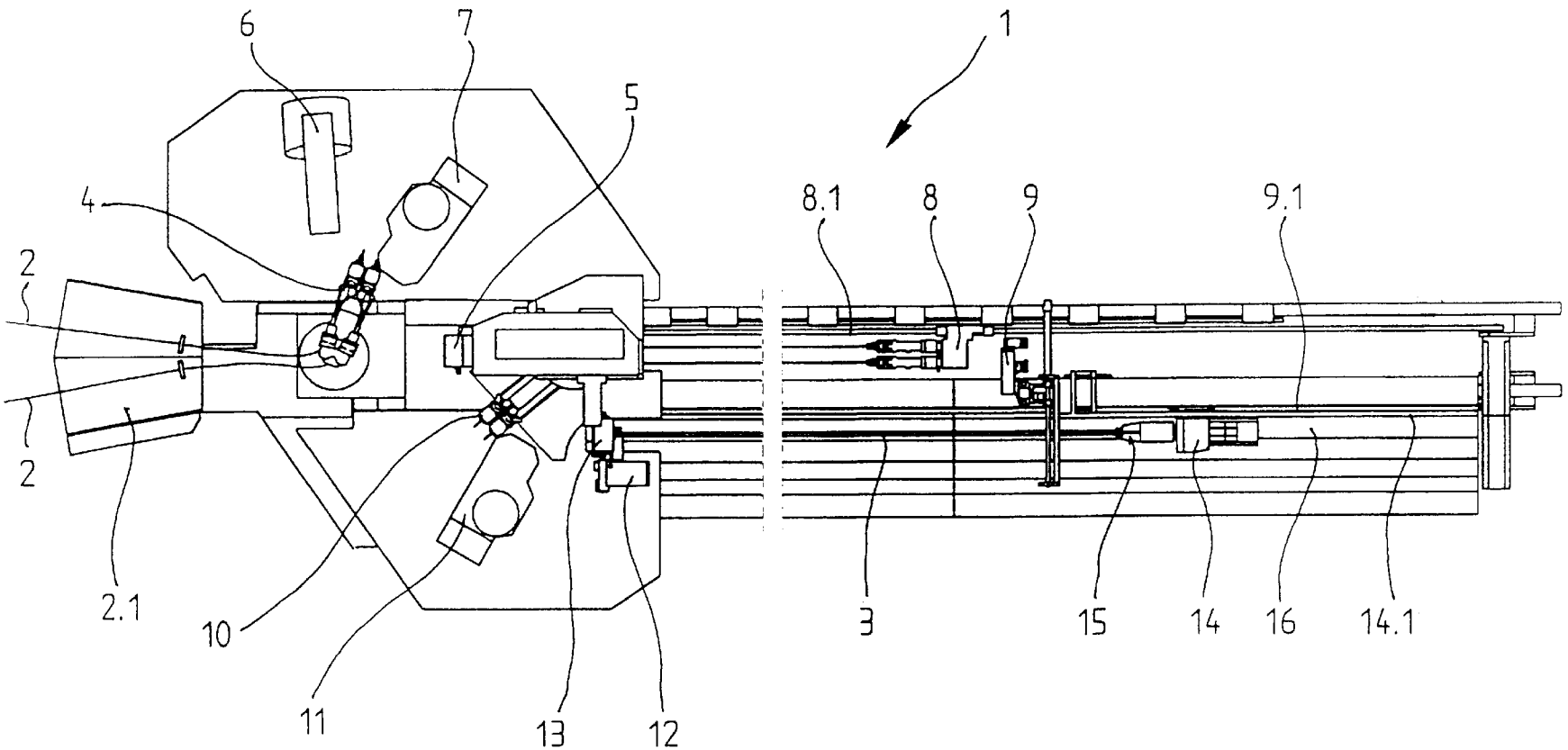
FIG. 1 shows twisting equipment according to the invention for the twisting together of conductor pairs.

A twisting apparatus, by means of which conductors 2 are twisted together into a conductor pair 3, is denoted by 1 in FIGS. 1 to 9. The conductors 2 are fed by way of a feeding station 2.1 from a not shown cable roll to the device 4-7 for the conductor end treatment. A first pivotal unit 4 serves as a feeder for the treatment of the leading conductor ends in the individual treatment stations. The pivotal unit 4 firmly grips the leading conductor ends of the conductors 2 with double grippers and brings them to an insulation-stripping device 5 for stripping the installation of the conductor insulation, the conductor ends then passing by a rotary movement to an automatic sleeving device 6 for equipping the conductor ends with a sealing sleeve and by a further rotary movement to a first automatic crimping device 7 for the producing of a crimp connection between a contact and the electrical conductor of the conductor. The automatic sleeving device 6 can be arranged before the first crimping device 7 or not be provided.

After the treatment and equipping, the leading conductor ends are taken over by an extraction carriage 8 movable along a first rail 8.1 and stretched to the desired length while maintaining a preset tension in the individual conductors and the leading conductor ends are delivered to a take-over module 9, which is movable along a second rail 9.1 and clamps the conductors 2, moves them to a lower position and brings the conductors 2 to a smaller conductor spacing. Thereafter, the extraction carriage 8 is ready for the return travel.

In the meantime, the conductors 2 have been seized by the first pivotal unit 4 and by a second pivotal unit 10. Then, the conductors 2 are separated and stripped of insulation by means of the insulation-stripping device 5. The trailing conductor ends are retained by means of the second pivotal unit 10 and have their insulation stripped off by the insulation-stripping device 5. The trailing conductor ends are brought by the second pivotal unit 10 to a second automatic crimping device 11, which crimp connects each conductor end with a contact. After the treatment and equipping, the trailing conductor ends are transferred to a transfer module 12. Subsequently, the second pivotal unit 10 pivots back again and can take over the next conductors.

The transfer module 12 brings the trailing conductor ends to a smaller conductor spacing already set by the take-over module 9 at the leading conductor ends. At the same time, the transfer module 12 pivots through 90°, brings the trailing conductor ends to an upper position and transfers the conductor ends to a retaining module 13. Simultaneously with the conductor transfer from the transfer module 12 to the retaining module 13, the leading conductor ends are brought by the transfer module 9 to a twisting head 15 arranged on a twisting carriage 14 movable along a third rail 14.1. Subsequently, a stretching of the conductors 2 takes place and then the twisting together of the conductor pair while maintaining a preset tension force. After the twisting together, the conductor pair passes into a deposit 16. Parameters specific to the cable, such as tension force during the twisting, lay length and free conductor length specifically for the connection, are preset. During the twisting together, the length of the conductor pair shortens and also the twisting carriage 14 moves accordingly while maintaining the preset tension forces. The untwisted cable length is dependent on the cable diameter and the parameters mentioned above and is computed by a program. The extraction carriage 8, the transfer module 9 and the twisting carriage 14 move to the computed positions.

During the equipping of the trailing conductor ends of the conductors 2, the leading conductor ends of the next conductor pair are treated, equipped and stretched. During the twisting of the conductors 2, the trailing conductor ends of the next conductor pair are treated and equipped.

At the same time, the leading conductor ends of a conductor pair are treated and equipped, a stretched conductor pair is treated, equipped and transferred and a conductor pair is twisted by the equipment according to the invention.

Figure 2:
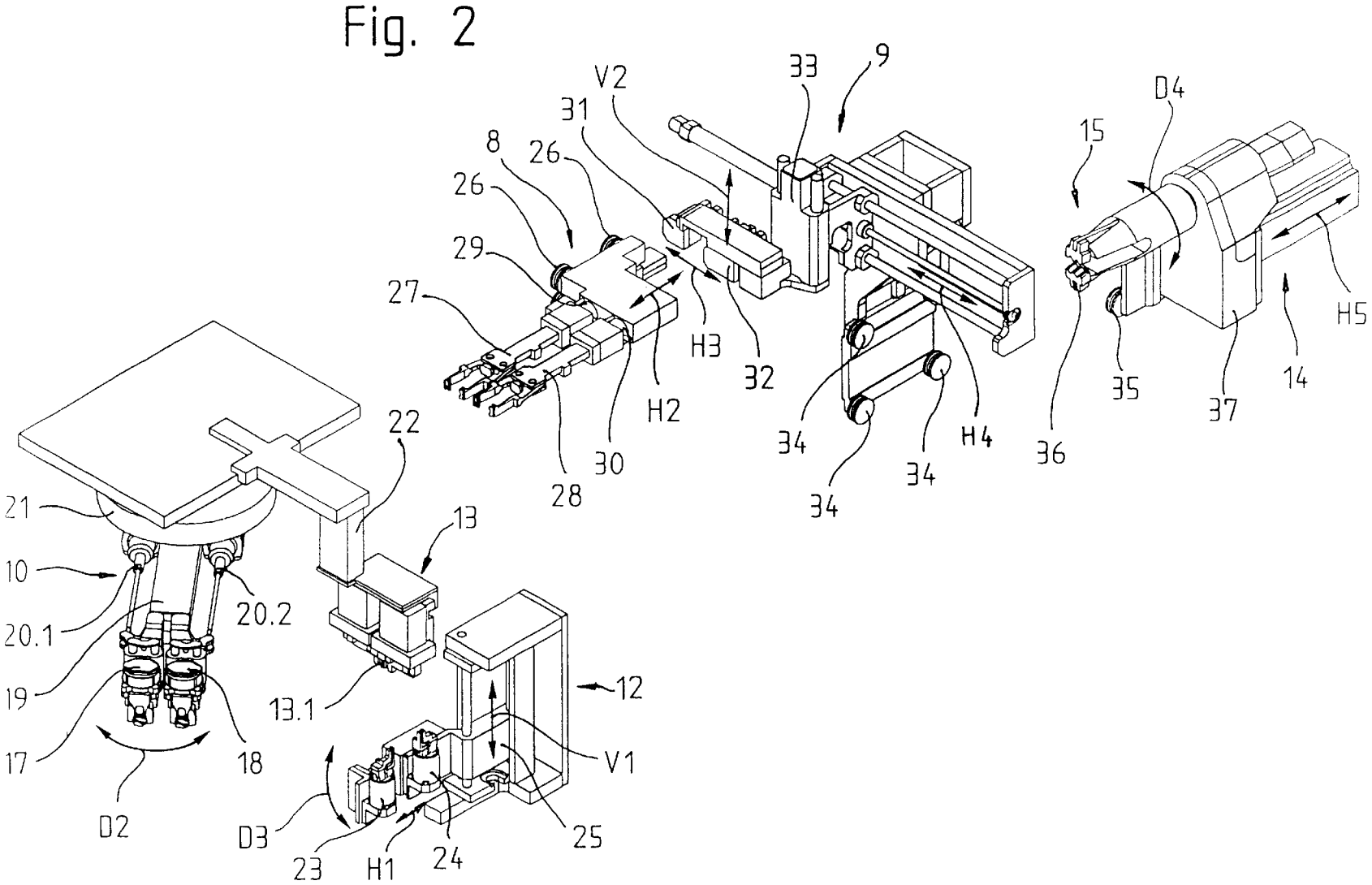
FIG. 2 shows the movement directions of the individual units for the manipulation of the conductor pairs.

FIG. 2 shows the movement directions of the individual units for the manipulation of the conductor pairs. The first pivotal unit 4 is comparable with the second pivotal unit 10 and is thus not illustrated in FIG. 2. The pivotal units 4 and 10 can execute a first or a second rotary movement D2. The pivotal units 4 and 10 serve as feeders of the cable ends to the treatment and transfer units and are each equipped with a respective first or second gripper pair 17, 18. The grippers 17, 18 are pivotally mounted at an arm 19 and are each pivoted by means of a respective pivot drive 20.1, 20.2. For example during the crimping process, a gripper must for reasons of space be pivoted out of the working range of the automatic crimping device 7 and 11, the conductor ends being equipped one after the other. The arms 19 and the pivot drives 20.1 and 20.2 are arranged at a platform 21 executing the rotary movement D2.

The retaining module 13 with a first double gripper 13.1 is firmly arranged at a carrier 22 and is served with conductor ends by the transfer module 12. The transfer module 12 is served with conductor ends from the second pivotal unit 10, which are retained by a third gripper pair 23, 24, which, after the take-over, brings the conductor ends to a smaller conductor spacing by means of a first horizontal movement H1. The conductor ends are fed by means of a third rotary movement D3 through 90° and a first vertical movement V1 to the retaining module 13, wherein the third gripper pair 23, 24 is movable by means of a rotatable and vertically displaceable bracket 25.

At the extraction carriage 8, which is movable and guided by means of first rollers 26, there is arranged a fourth gripper pair 27, 28, which by means of a second horizontal movement H2 takes over the conductor ends at the insulation-stripping equipment 5 and stretches the conductors 2 to the desired length, wherein a respective force sensor 29, 30 detects the tension force in the conductor 2 for each gripper 27, 28. The stretched conductors 2 are taken over by a fifth gripper pair 31, 32 of the take-over module 8. The fifth gripper pair 31, 32 is arranged at a second bracket 33, which can execute a second vertical movement V2 and a third horizontal movement H3 and a fourth horizontal movement H4. After the take-over, the conductor ends are brought to a smaller spacing by means of the third horizontal movement H3, are moved vertically downwards and fed horizontally to the twisting head 15. The take-over module is guided and movable by means of second rollers 34.

The twisting head 15, which is arranged at the twisting carriage 14 movable and guided by means of third rollers 35, firmly retains the conductor ends by means of a second double gripper 36. During the conductor twisting, the twisting head 14 arranged at a third bracket 37 of the twisting carriage 14 executes a fourth rotary movement D4 and the twisting carriage 14 displaces in the conductor direction by means of a fifth horizontal movement H5.

Figure 3:
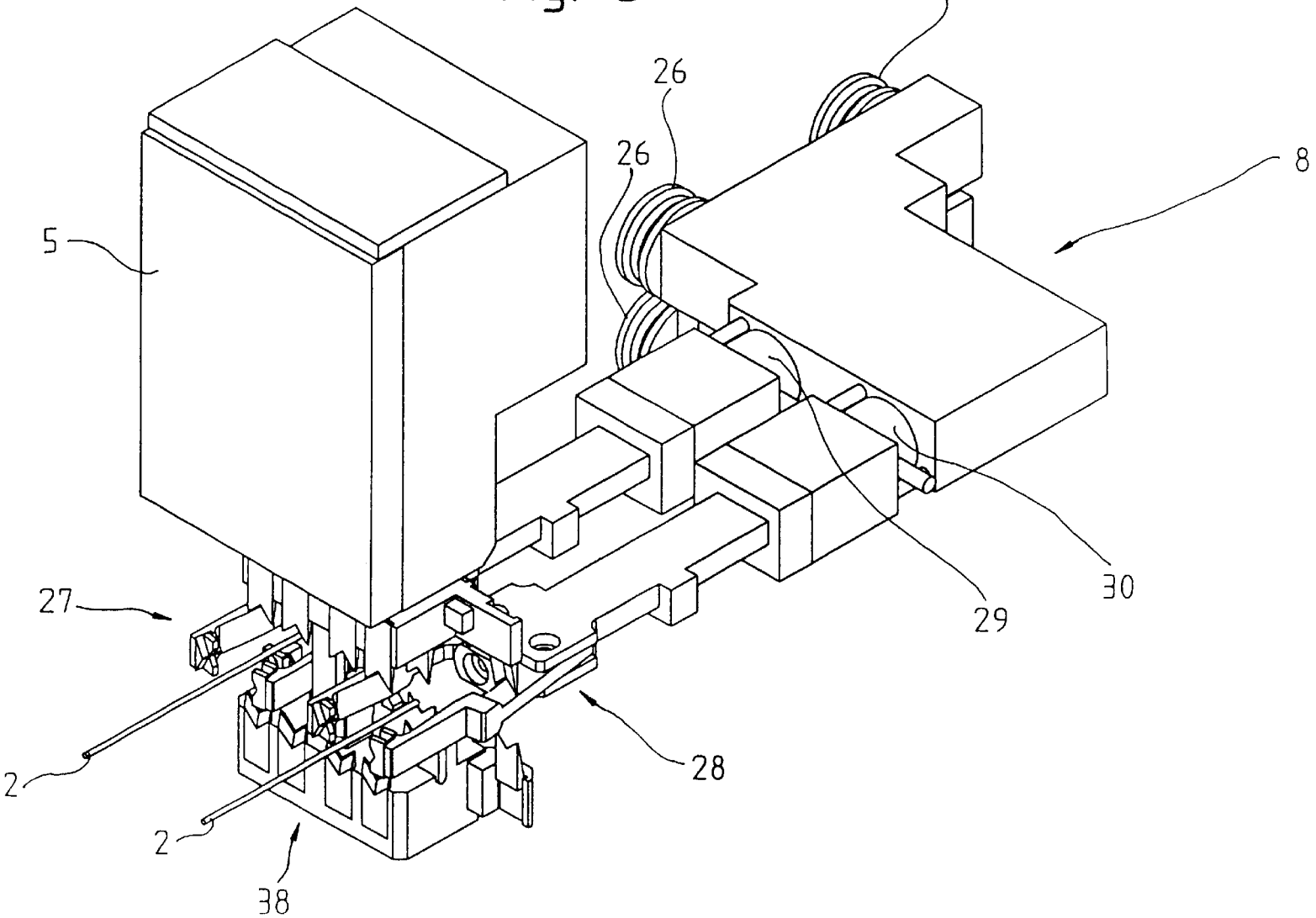
FIG. 3 shows details of an extraction carriage during the taking-over of leading conductor ends.

FIG. 3 shows details of the extraction carriage 8 during the taking-over of the leading conductor ends with not-illustrated contacts or with contacts and sleeves. The flatly constructed fourth gripper pair 27, 28 engages through the insulation-stripping device 5 and takes over the conductor ends from the first pivotal unit 4. During the stretching, the tension force per conductor 2 can be detected by means of the first force sensor 29, 30. A not-illustrated switching circuit monitors the tension force in the conductor on the basis of a preset force and the measured force. The insulation-stripping device 5 is equipped with several double blades 38, wherein the blades at the extraction carriage side serve for the conductor severing and the blades at the pivotal unit side serve for the insulation-stripping.

Figure 4:
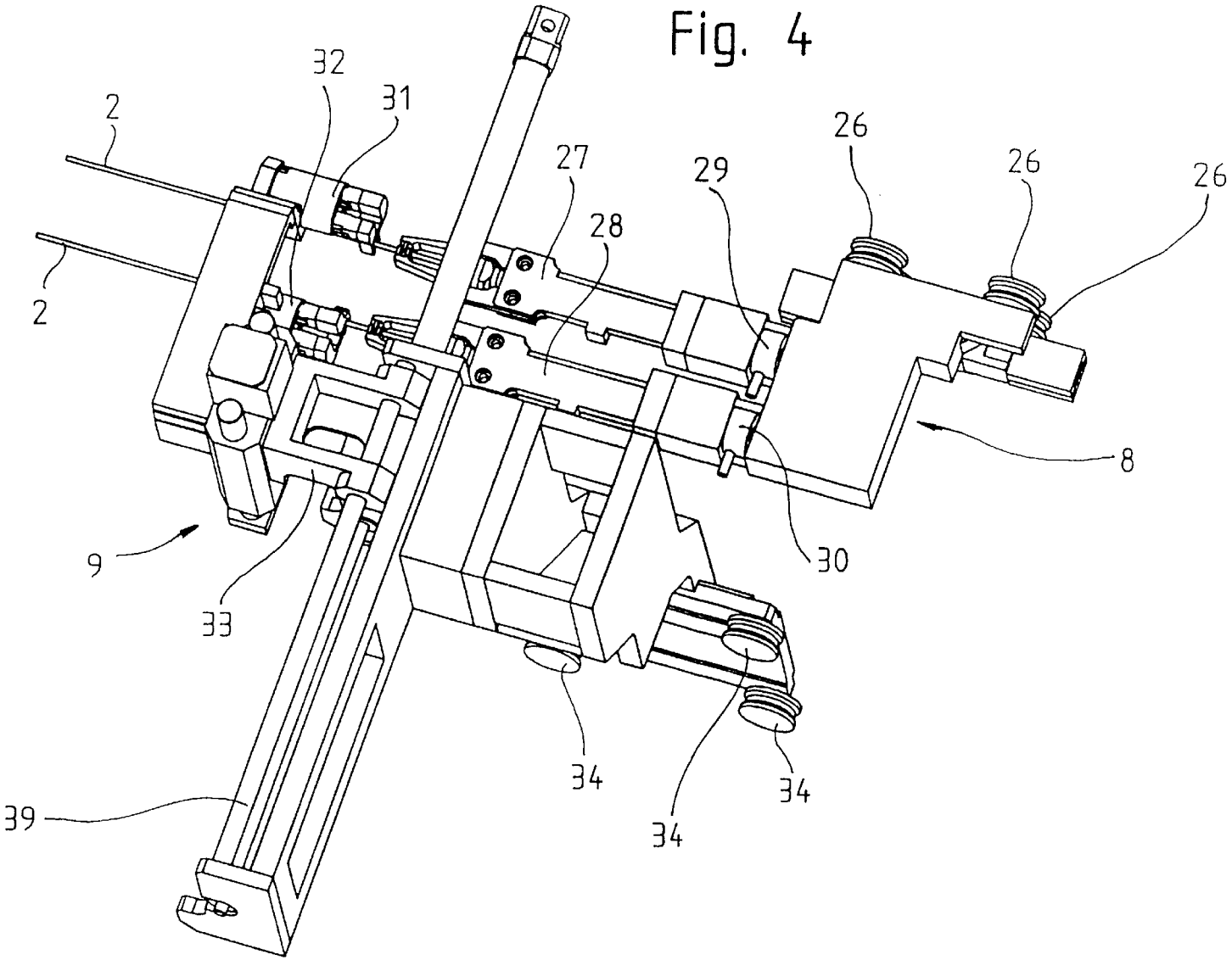
FIG. 4 shows details of a take-over module during the taking-over of conductor ends from the extraction carriage.
Figure 5:
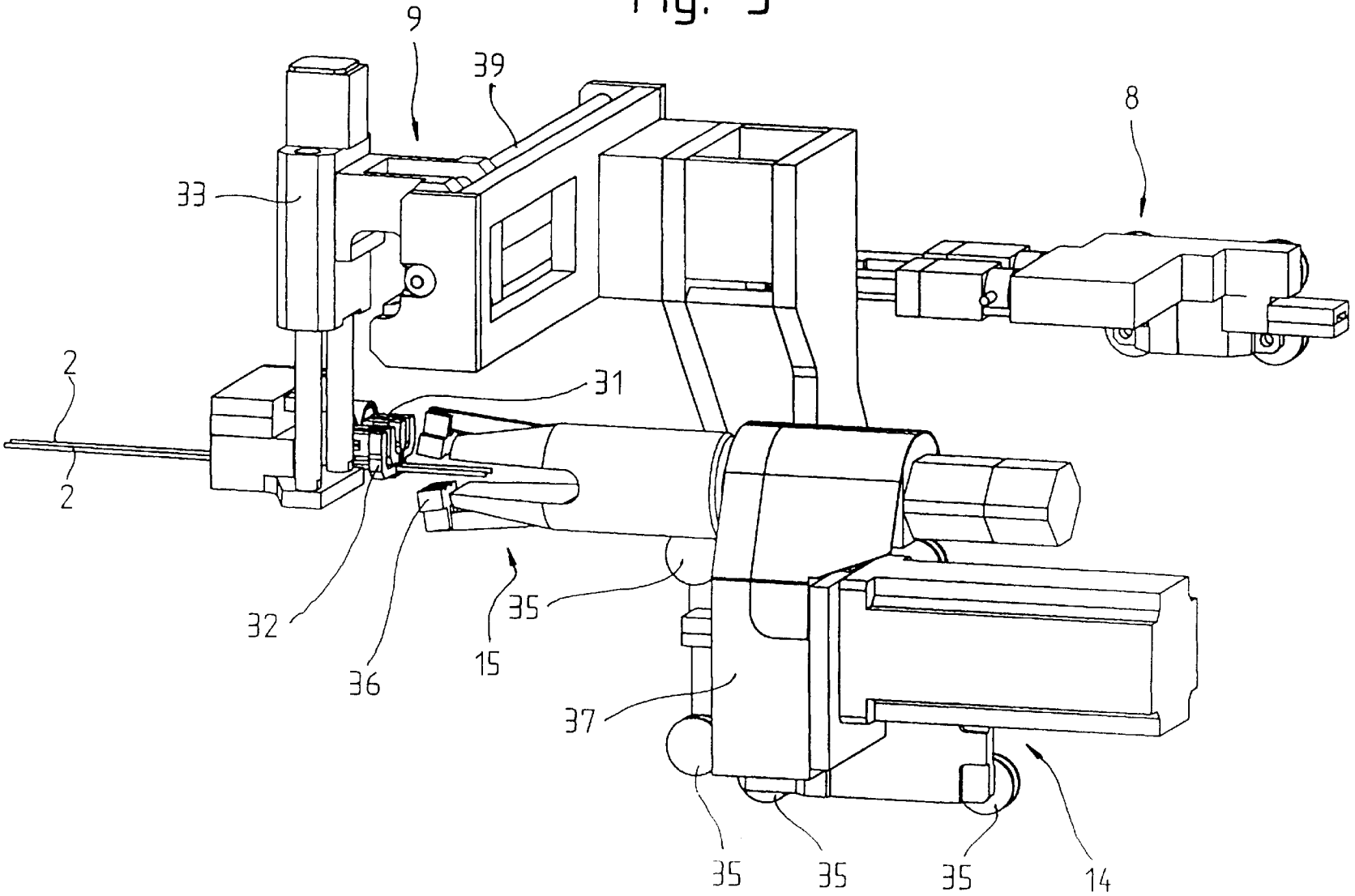
FIG. 5 shows a twisting head during the taking-over of conductor ends from the take-over module.

FIG. 4 shows details of the take-over module 9 during the taking-over of conductor ends from the extraction carriage 8. The fifth gripper pair 31, 32 engages from above onto the conductor ends retained by the fourth gripper pair 27, 28 of the extraction carriage 8 and subsequently executes the second vertical movement V2 downwardly to the height of the center of the twisting head 15. Thereafter, the second bracket 33 is moved along a linear guide 39 until the conductor ends can, as shown in FIG. 5, be seized by the second double gripper 36 of the twisting head 15.

Figure 6:
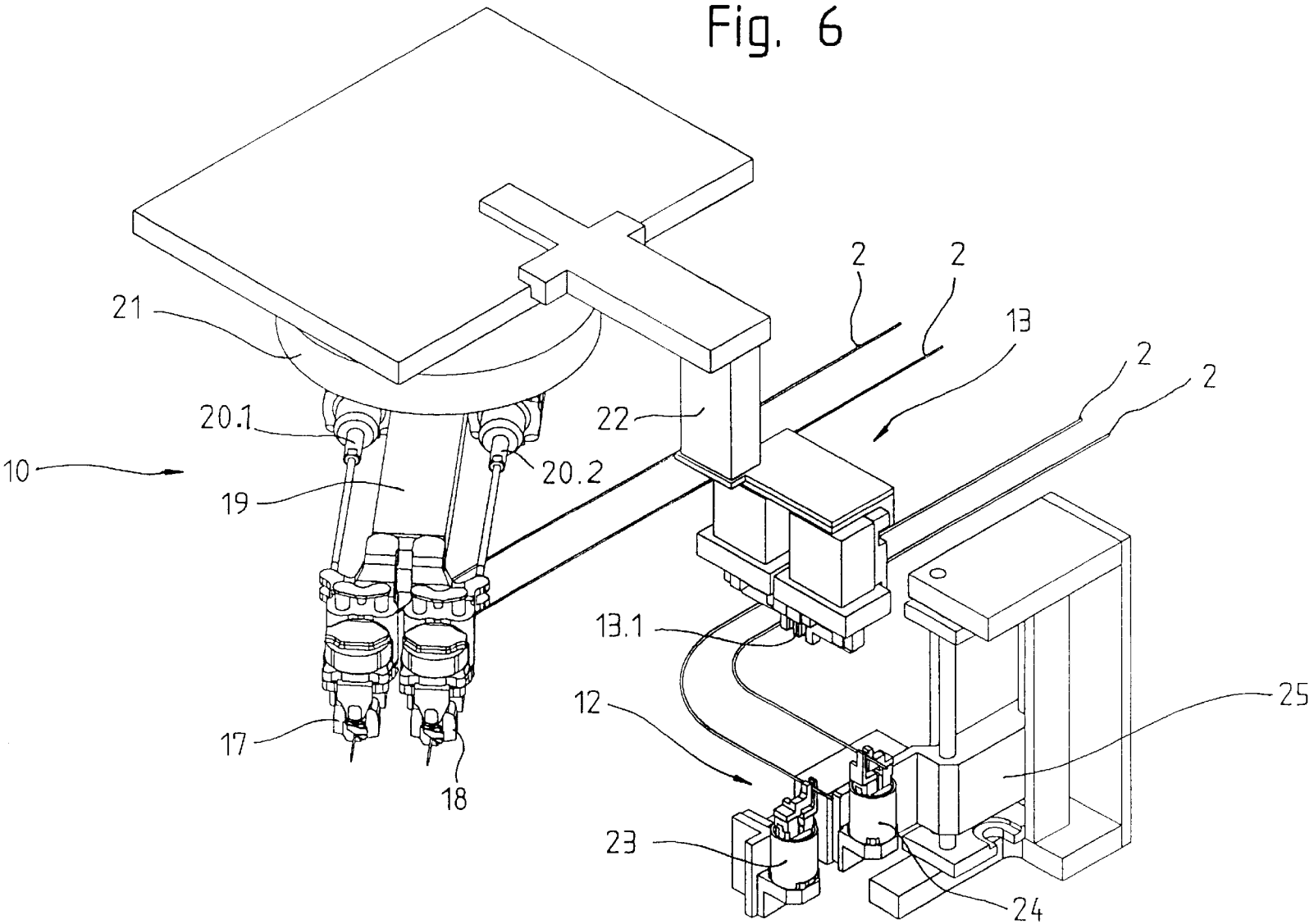
FIG. 6 shows a second pivotal unit and a transfer module during the manipulation of trailing conductor ends.

FIG. 6 shows the second pivotal unit 10 and the transfer module 12 during the manipulation of conductor ends. The second pivotal unit 10 moves, for example to the second automatic crimping device 11, with a conductor pair for equipping with contacts, wherein the one gripper 17, 18 in the working range of the automatic crimping device 11 is pivoted out of the working range of the automatic crimping device 11 and the other gripper 17, 18 serves the automatic crimping device with a conductor end. The transfer module 12 is shown with a conductor pair after the take-over. The conductor spacing is now reduced by means of the first horizontal movement H1 to the gripper raster of the retaining module 13. Subsequently, the conductor pair is transferred to the retaining module 13, as described further above.

Figure 7:
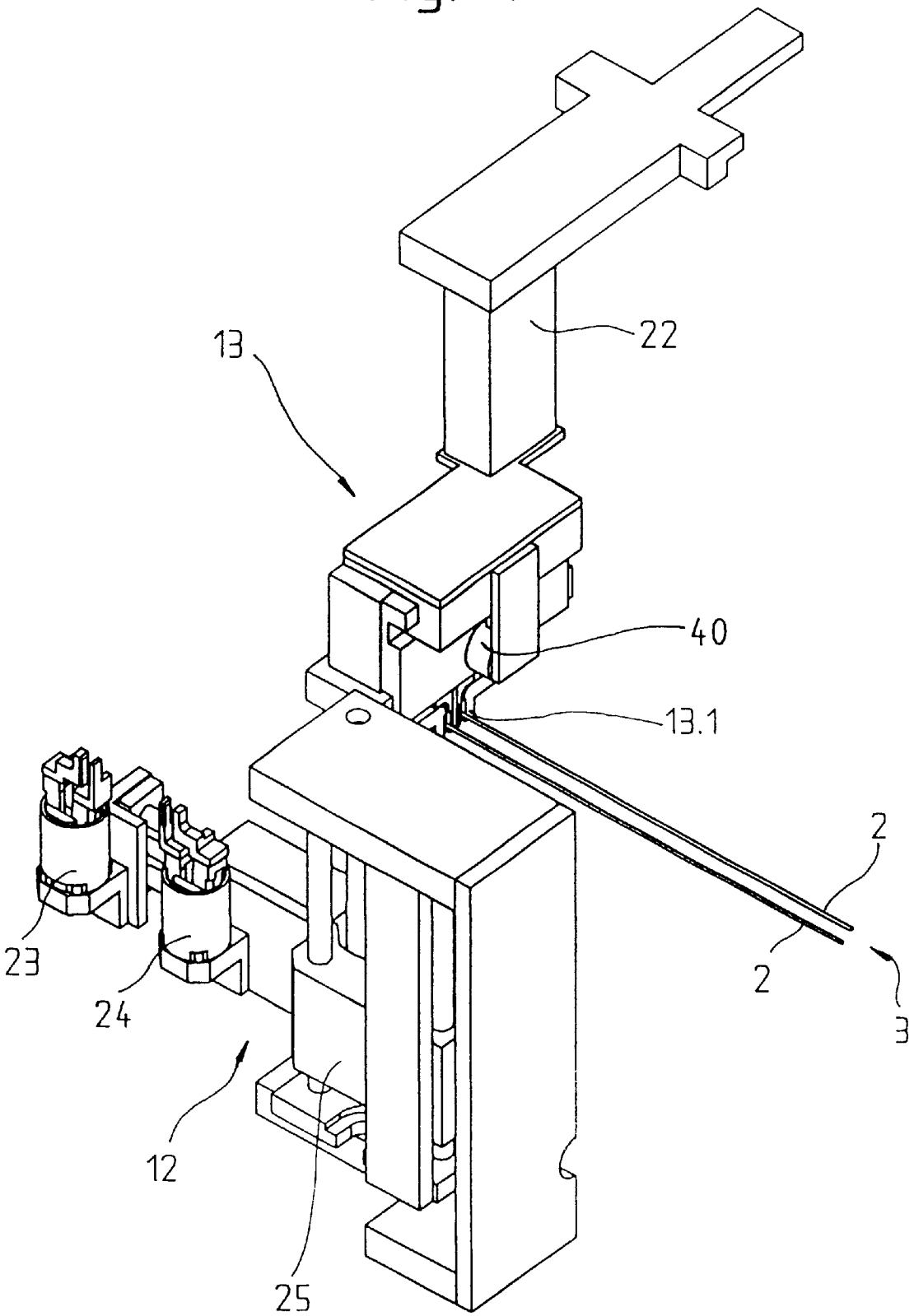
FIG. 7 shows a retaining module with a conductor pair before the twisting together.

FIG. 7 shows the retaining module 13 with a conductor pair before the twisting-together. The conductors 2 are held fast by means of the first double gripper 13.1. A force sensor 40 detects the tension force in the conductor pair. A not-illustrated regulator can regulate the tension force during the twisting-together on the basis of the preset force and the measured force.

Figure 8:
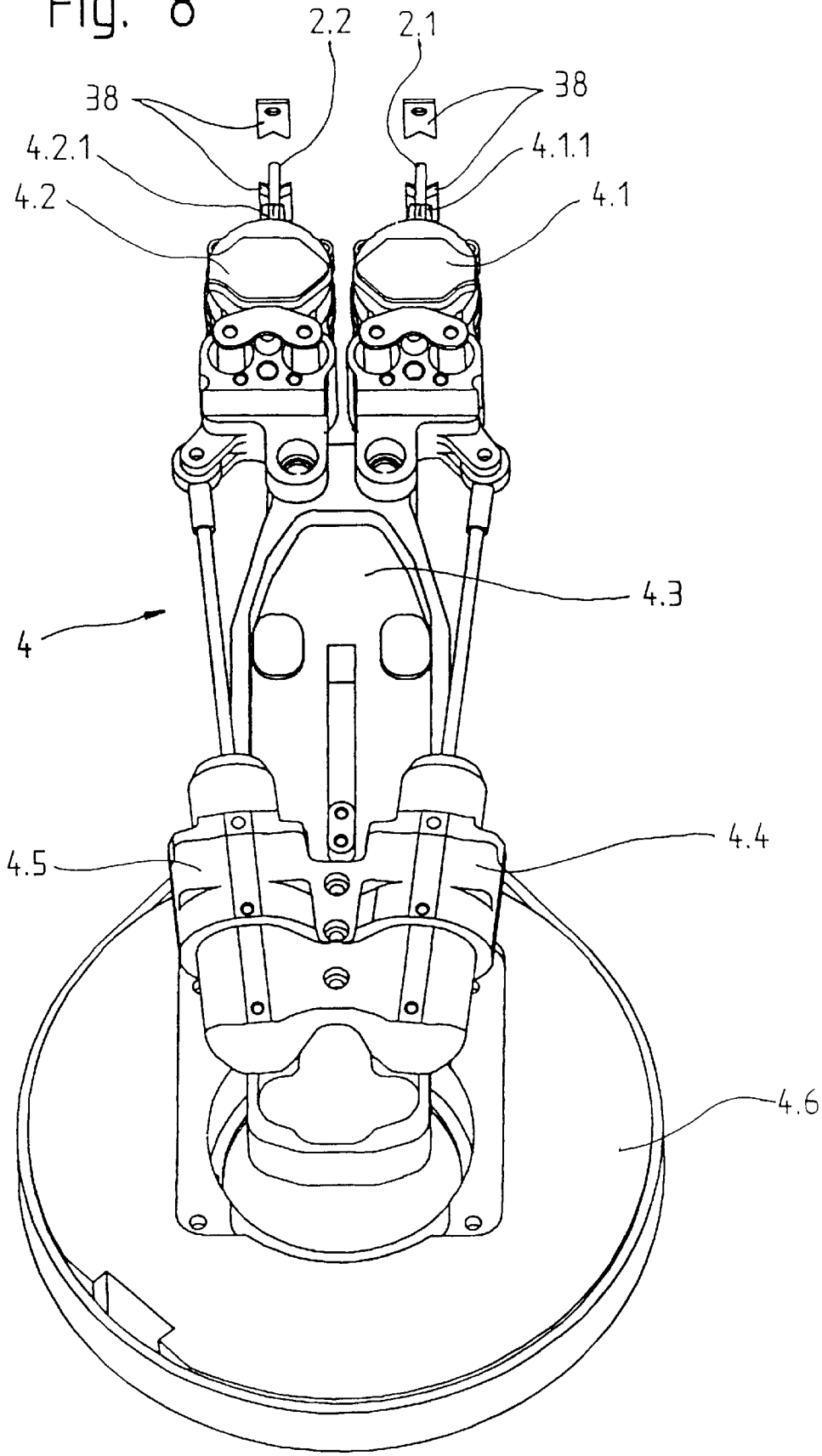
FIG. 8 shows details of a first pivotal unit for the manipulation of the leading conductor ends.

The first pivotal unit 4 shown in FIG. 8 serves for the feeding of the leading conductor ends 2.1, 2.2, called side "1" in the jargon of the art, to the treatment stations 5, 6 and 7. The conductor ends 2.1, 2.2 are drawn through the grippers 4.1, 4.2 by means of the extraction carriage 8. The grippers 4.1, 4.2 have guide tubes 4.1.1, 4.2.1 at the treatment side, which serve to guide the conductor ends 2.1, 2.2. The build-up of the grippers 4.1, 4.2 of the side 1 is in such a manner that they can merely retain the conductor ends 2.1, 2.2. The grippers 4.1, 4.2 are arranged at an arm 4.3 and are individually pivotable by means of pivot drives 4.4, 4.5, wherein the respective setting is dependent on the treatment station 5, 6 and 7. For the free rotation of the grippers 4.1, 4.2 from one treatment station to the next treatment station, the grippers 4.1, 4.2 are moved linearly towards the platform 4.6. For this purpose, the arms 4.3 and the pivot drives 4.4, 4.5 are arranged to be linearly displaceable at the platform 4.6. The drives for the linear movement or for the rotational movement are not illustrated.

Figure 9:
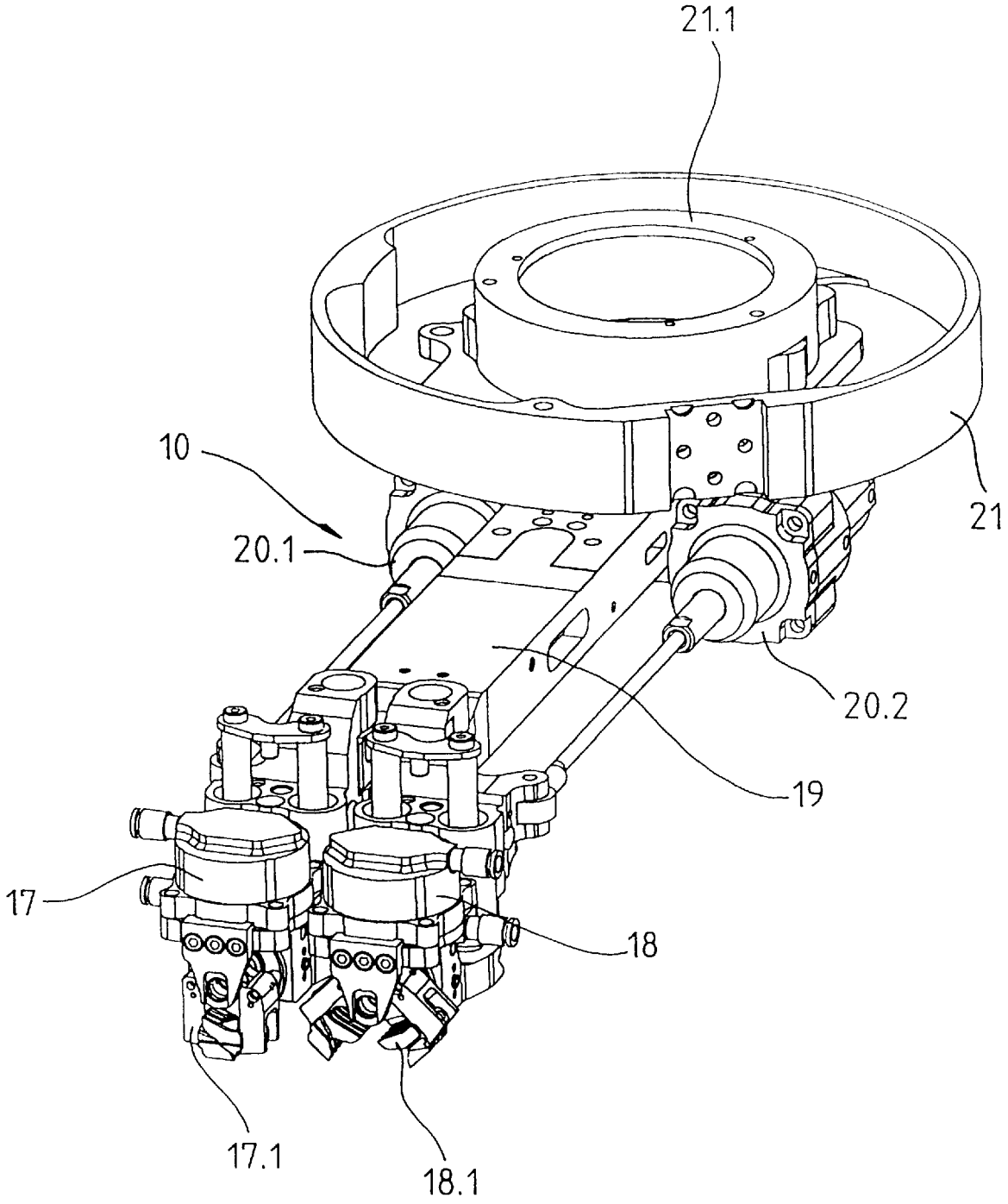
FIG. 9 shows details of the second pivotal unit for the manipulation of the trailing conductor ends.

The grippers 4.1, 4.2 return to the insulation stripping equipment 5 after the production of the side 1 ready for use. The conductors 2 are then stretched to the desired length by means of the extraction carriage 8 and the trailing conductor ends, called side "2" in the jargon of the art, are taken over by the second pivotal unit 10, according to FIG. 9. The second pivotal unit 10 according to FIG. 9 is equipped with the grippers 17, 18, which can seize, retain or let go of the conductor ends. For the execution of these functions, gripper jaws 17.1, 18.1 are necessary, which can open and close. FIG. 9 shows the one gripper 17 with closed, interengaging gripper jaws 17.1 and the other gripper 18 with opened gripper jaws 18.1. Furthermore, in the case of the second pivotal unit 10 according to FIG. 9 and by contrast to the first pivotal unit 4 according to FIG. 8, the pivot drives 20.1, 20.2 are arranged underneath the platform 21 and the drive for the linear movement is arranged above it. A flange, at which the drive for the linear movement is arranged, is denoted by 21.1. For example, a not-illustrated pinion engages into a not-illustrated toothed rack and produces the linear displacement of the arm 19 and of the pivot drives 20.1, 20.2.

The invention is not limited by the embodiments described above which are presented as examples only but can be modified in various ways within the scope of protection defined by the appended patent claims.

I claim:

1. A method for treating and twisting together a succession of conductor pairs, comprising the steps of:

a) treating leading ends of a pair of conductors in the succession;

b) drawing out the conductors of said pair of conductors to subject them to a one-time stretching;

c) treating trailing ends of said pair of conductors;

d) clamping the leading and trailing ends of said pair of conductors;

e) twisting together the conductors of said pair of conductors from a common end of each; and practicing steps a)–e) on succeeding conductor pairs, while performing at least two of the following steps simultaneously, the treatment of the trailing ends of a conductor pair next following said pair of conductors in the succession, the treating of the leading ends of a conductor pair second next following said pair of conductors in the succession, and the twisting together of said pair of conductors.

2. A method according to claim 1, wherein said conductor pair is not changed substantially in a positioning thereof after clamping of said conductor pair.

3. A method according to claim 1, wherein one of the drawing-out and the twisting together of the conductor pair takes place while maintaining a preset tension force.

4. An apparatus for treating and twisting together a conductor pair, comprising:

a device for treating and equipping leading and trailing ends of the conductor pair;

a device for subsequently twisting together the conductor pair, wherein the treating and equipping device includes units for treating and equipping the trailing conductor ends which are arranged directly beside the twisting device;

an extraction carriage operatively arranged behind the treating and equipping units for the leading ends of the conductor pair so as to engage the leading conductor ends and draw out the conductor pair;

a transfer module operatively arranged so as to take over the treated trailing conductor ends and transfer the trailing ends to the twisting device; and a take-over module operatively arranged to take-over the leading conductor ends from the extraction carriage and transfer the leading ends to the twisting device.

5. An apparatus according to claim 4, and further comprising pivotal units for manipulating the conductor ends, the pivotal units including pivotable grippers which are pivotable into and out of working regions of the treating and equipping units.

6. An apparatus according to claim 4, wherein the extraction carriage comprises a gripper pair with force sensors which are operatively arranged so as to measure tension force in the conductors of the conductor pair during the extraction.

7. An apparatus according to claim 4, and further comprising a bracket operative to execute a vertical movement and a horizontal movement for transferring the conductor pair to the twisting device, the take-over module comprising a gripper pair operative to match conductor spacing of the extraction carriage to gripper raster of the twisting device, the gripper pair of the take-over module being mounted on the bracket.

8. An apparatus according to claim 4, and further comprising a retaining module having grippers, the transfer module comprising a gripper pair operative to match conductor spacing of the second pivotal unit and gripper raster of the retaining module, the gripper pair being arranged at a bracket which executes a vertical movement and a rotational movement for transfer of the conductor pair to the retaining module.

9. An apparatus according to claim 8, wherein the retaining module comprises a double gripper with a force sensor operatively arranged to measure of the tension force in the conductor pair during twisting together of the conductor.

* * * * *